United States Patent [19]

Müller et al.

[11] Patent Number: 4,671,418

[45] Date of Patent: Jun. 9, 1987

[54] APPARATUS FOR LASHING GOODS

[75] Inventors: Anton Müller, Aalen-Unterkochen; Karl Herdeg, Aalen; Hermann Schinko, Hüttlingen; Günter Leyermann, Duisburg; Richard Kimmit, Duisburg; Frank Meyer, Duisburg, all of Fed. Rep. of Germany

[73] Assignee: Eisen- und Drahtwerk Erlau Aktiengesellschaft, Aalen, Fed. Rep. of Germany

[21] Appl. No.: 607,152

[22] Filed: May 4, 1984

[30] Foreign Application Priority Data

May 4, 1983 [DE] Fed. Rep. of Germany ..... 3316175

[51] Int. Cl.[4] ..... A47F 5/00

[52] U.S. Cl. ..... 211/59.4; 211/49.1; 294/67.4; 294/67.41

[58] Field of Search ..... 211/59.4, 60.1, 70.4, 211/49.1; 108/51, 55.3, 52.1; 248/346; 294/81.55, 67.4, 67.41

[56] References Cited

U.S. PATENT DOCUMENTS

| | | | |
|---|---|---|---|
| 210,527 | 12/1878 | Harris | 294/67.41 X |
| 967,275 | 8/1910 | Walker | 294/81.55 X |
| 3,239,076 | 3/1966 | Huff et al. | 294/67.4 X |
| 3,239,265 | 3/1966 | Scibilia | 294/67.4 |

FOREIGN PATENT DOCUMENTS

| | | | |
|---|---|---|---|
| 257223 | 1/1963 | Australia | 294/67.4 |
| 289957 | 6/1965 | Netherlands | 294/67.41 |

*Primary Examiner*—Robert W. Gibson, Jr.
*Attorney, Agent, or Firm*—Becker & Becker, Inc.

[57] ABSTRACT

An apparatus for lashing goods, such as boards, bars, sheets, and the like. The apparatus includes portable supports for the goods which are to be lashed. The supports are provided with connections for lashing chains, ropes, or the like. The support has stops, counter-stops disposed at right angles to its longitudinal direction, and stacking surfaces. The supports can be stacked for transport in such a way that they cannot slip with respect to one another, and they can be placed reliably one on top of the other.

20 Claims, 14 Drawing Figures

VI

Fig.9
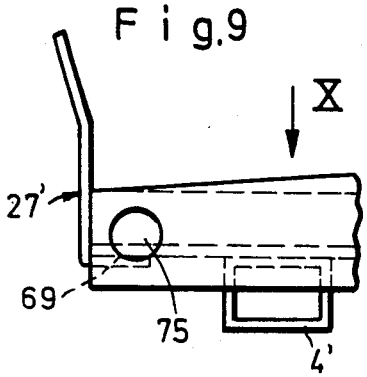
Fig.11
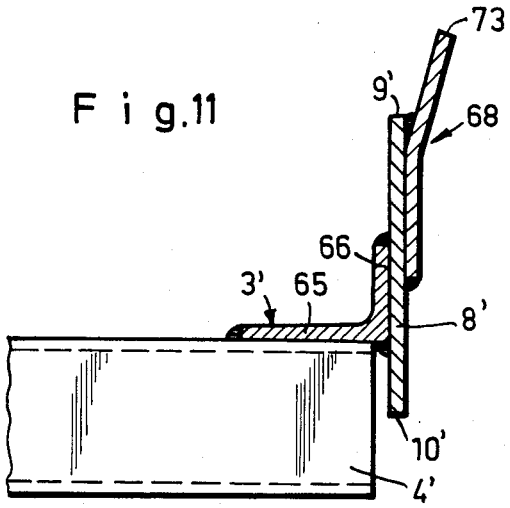
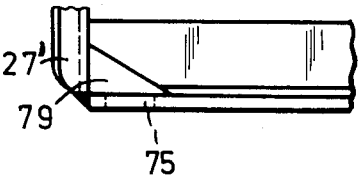
Fig.10
Fig.14
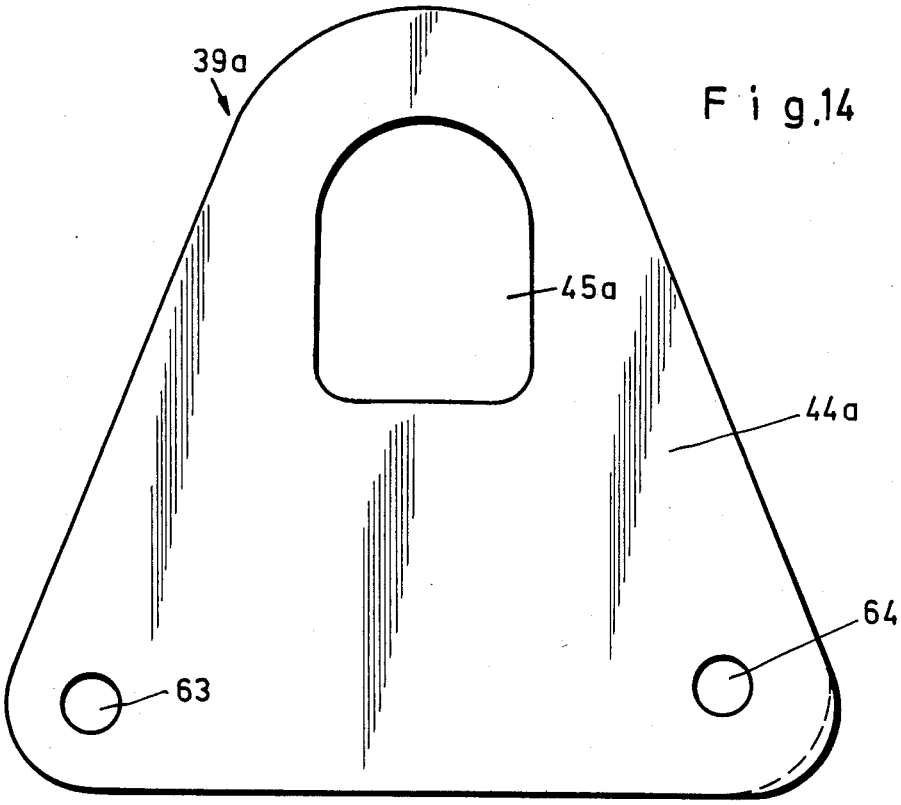

APPARATUS FOR LASHING GOODS

BACKGROUND OF THE INVENTION

1. Field of the Invention

The present invention relates to an apparatus for lashing goods, such as boards, bars, sheets, and the like; at least one lashing means is wound at least partly around the goods, and in the lashed position is held taut by at least one retaining device.

2. Description of the Prior Art

In a known apparatus of this general type, steel bands, chains, wires, and the like are used as lashing means, which are wound around the goods to be lashed and are held in the taut position by a mounting. Bundled goods can usually only be deposited side by side during transport, but cannot be stacked, because there is a danger that the goods may slip. Therefore, the bundled goods require a considerable amount of space, which makes transportation more expensive.

An object of the present invention is to construct an apparatus of this general type in such a way that bundled goods can be stacked for transport and can be secured so that they cannot slide with respect to one another.

BRIEF DESCRIPTION OF THE DRAWINGS

This object, and other objects and advantages of the present invention, will appear more clearly from the following specification in conjunction with the accompanying drawings, in which:

FIG. 9 shows the detail IX in FIG. 8, to an enlarged scale;

FIG. 10 is a view taken in the direction of arrow X of FIG. 9;

FIG. 11 is a cross-sectional view taken along line XI—XI of FIG. 8;

FIG. 14 is an elevational view that shows a second embodiment of a cross beam.

SUMMARY OF THE INVENTION

Figures 1, 2, 3, 4, 5, 6:
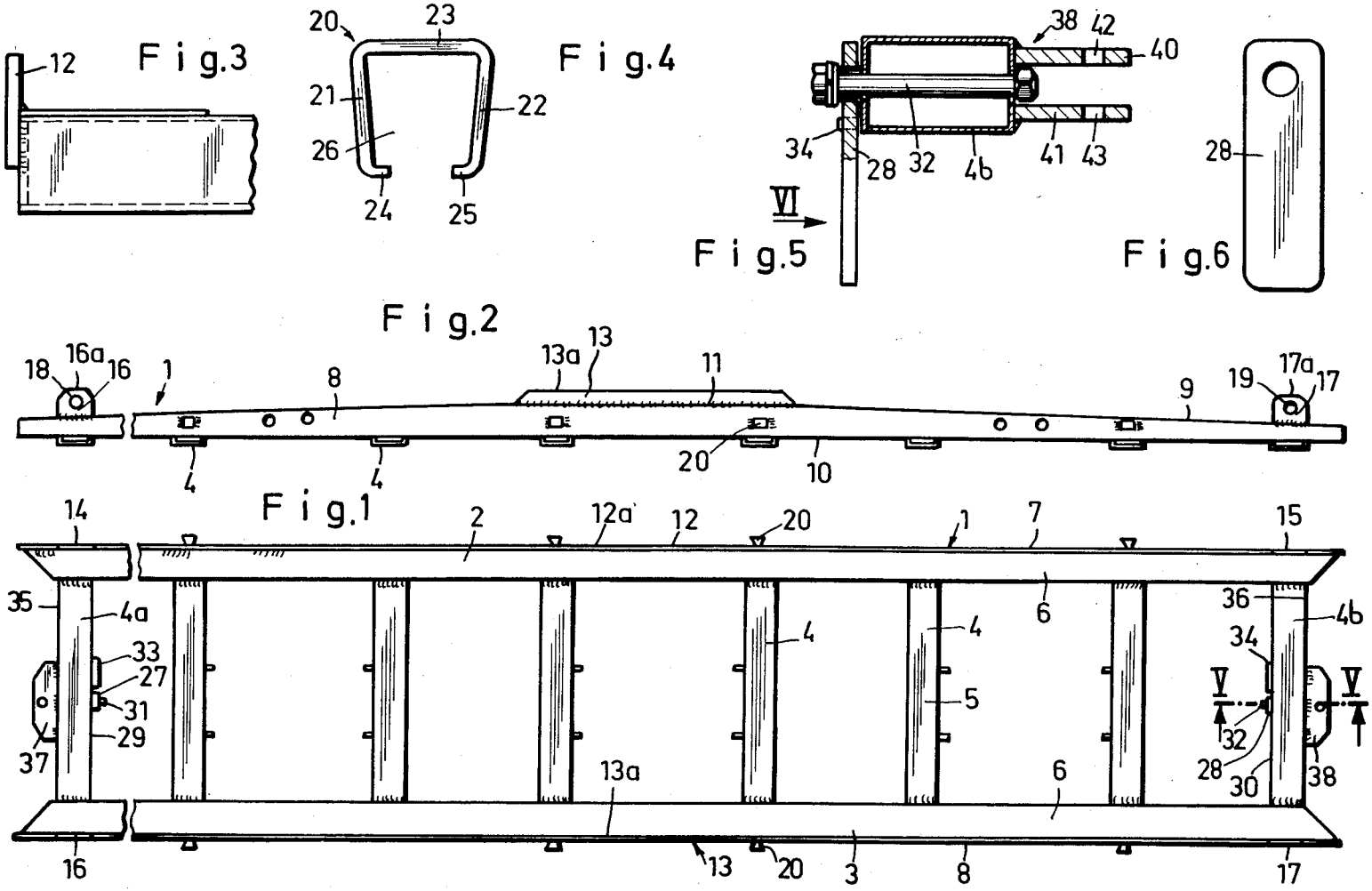
FIG. 1 is a plan view that shows a first embodiment of a support according to the invention.
FIG. 2 is side view that shows the support according to FIG. 1.
FIG. 3 shows a lateral stop of the support of FIG. 1, to an enlarged scale.
FIG. 4 shows a lateral mounting of the support of FIG. 1, to an enlarged scale and in plan view.
FIG. 5 is a section taken on line V—V of FIG. 1, to an enlarged scale.
FIG. 6 is a view taken in the direction of arrow VI in FIG. 5.

The inventive apparatus is characterized primarily by at least one portable support for the goods, each support having at least one stop, at least one counter-stop disposed at right angles to the longitudinal direction of the support, and at least one stacking surface.

In the apparatus according to the present invention, the support is provided with the stop and counter-stop.

When the supports are stacked one on top of another, then the stops of one support are associated with the counter-stops of the respectively adjacent support. Since the counter-stop extends at right angles to the longitudinal direction of the support, shifting of the supports in the longitudinal direction of the supports is precluded. As a result, the supports can be transported in the stacked position without there being any risk of any slipping therebetween and thus forming a source of danger therewith. The supports can also be stacked securely one on the other on the stacking surfaces. The bundled goods require only a small amount of space for transport; as a result of which transportation costs can be kept low.

Pursuant to further features of the present invention, each stop may be provided in the region of one end of each support, and preferably in the region of each end of each support.

Each stop may be a cross bar which connects the free ends of the longitudinal members of the support.

Each stop can be adapted to be moved, preferably by being pivoted, from an arresting position into a releasing position. Each stop may be provided on a cross member of a given support, preferably on an end cross member thereof. The stops may be provided on the facing inner sides of the end cross members. The adjusting movement of the stops may be limited by a respective transverse stop, preferably provided on the end cross members on their facing inner sides.

Respectively provided on end cross members may be a holder for a cross beam, which may be provided on that side of the end cross member opposite the stop. The cross beam may be formed by two plates which are spaced one above the other and project from the end cross member; at least one plate may be provided with an insertion opening for a retaining member.

The support may be provided with lateral stops on which are formed side parts which are preferably attached to the longitudinal members of said support. The lateral stops may be provided with mountings constructed as connection fittings for receiving stacking aids.

The cross beam may be formed by a plate having connections for strands of chain, ropes, and the like. The connections are preferably formed by brackets which are provided on opposite sides of said cross beam plate and project therebeyond. The brackets may be connected by transverse bolts, which form suspension members for connecting members, such as hooks. The connections may also be through-bores in the cross beam plate.

DESCRIPTION OF PREFERRED EMBODIMENTS

Referring now to the drawings in detail, the apparatus for lashing goods is preferably used underground in mining, where a large number of lining sheets, plates, steel mats, rails, boards, wooden runners, floor bars, wooden props, pipes, and the like have to be bundled and transported. These goods can be lashed on the spot with the inventive apparatus. The lashed goods can be received and conveyed without difficulty by varied forms of conveying means. Direct handling of the goods by hand is eliminated, so that endangering of personnel is largely precluded. However, in addition, the apparatus can also be used for lashing goods in aircraft, ships, on trucks, railways, in containers, and the like.

The apparatus has a portable support 1, on which the goods can be lashed. In the embodiment according to FIGS. 1 to 6, the support 1 comprises two longitudinal members 2 and 3, which extend parallel to one another and are connected to each other by cross members 4 which are spaced from, and extend parallel to, each other. The longitudinal members 2, 3 are respectively constructed as hollow sectional members, but may also have any other suitable sectional shape; for example, they may be constructed as L-shaped angle rails. The ends of each of the longitudinal members 2, 3 are bevelled. The cross members 4 are preferably also hollow sectional members, which project downwardly beyond the longitudinal members 2, 3 (FIG. 2). The upper side 5 of the cross members 4 lies in a common plane with the upper side 6 of the longitudinal members 2, 3, so that a flat support surface is formed for the goods which are to be deposited on the support 1.

Attached to the two longitudinal members 2, 3, on the outer sides thereof which are remote from one another, are side plates 7 and 8, which project upwardly beyond the longitudinal members 2, 3. The upper edge 9 of the side plates 7, 8 extends from the ends of the respective longitudinal members 2, 3 in an ascending manner, and half-way along the length of the longitudinal member passes into a central section 11 which is parallel to the lower edge 10. Provided respectively at the height of the central section 11 on the upper edge 9 of the side plates 7, 8 are lateral stops 12, 13, which can be formed by pieces of plate which are welded on, or can alternatively be constructed in one piece with the side plates. The lateral stops 12, 13 preferably extend over the length of the central section 11, the length of which is substantially less than the length of the longitudinal members 2, 3. The lower edge 10 of the side plates 7, 8 lies at the height of the underside of the longitudinal members. Provided close to the two ends of each longitudinal member 2, 3 on the side plates 7, 8 are splice plates or brackets 14–17 which project upwardly and can likewise be welded on or constructed in one piece with the side plates. The brackets are provided with suspension openings 18, 19 for lifting gear, by means of which the support 1 can be raised. The upper edges 12*a*, 13*a*, 16*a* and 17*a* of the lateral stops 12, 13 and of the brackets 14–17 form stacking surfaces on which the supports 1 lie in the stacked position.

In order to facilitate stacking of the goods which are to be lashed on the support 1, mountings 20 are provided on the outer sides of the side plates 7, 8; rods and the like can be inserted in these mountings. The mountings 20 are formed by sectional members (FIG. 4) which have an essentially U-shaped cross-section. The arms 21, 22 converge from the cross-piece 23, and their free ends 24, 25 are directed towards each other. The mountings 20 are welded to the outer sides of the side plates 7, 8 by means of the free ends 24, 25. The mountings 20 are attached in such a way that the insertion openings 26 are open toward the top or bottom, so that rods and the like can be inserted therein, which then project upwardly at right angles to the longitudinal members 2, 3. The mountings 20 are distributed along the side plates 7, 8 (FIGS. 1 and 2). When goods are to be stacked to relatively great heights on the support 1, appropriate rods are first inserted in the mountings 20 to limit the support laterally. The goods can then be stacked and lashed conveniently. Subsequently, the rods can be removed from the mountings 20.

The cross members 4 may serve as stops for containers which are deposited thereon. The containers are provided with counter-stops which engage in the region between the cross members 4. The distance between the cross members 4 is chosen in this case in such a way that the containers bear by means of these counter-stops on the cross members. Due to this, these containers can no longer slide accidentally in the longitudinal direction of the support.

A stop 27, 28 is respectively provided on at least one of the cross members 4, preferably on both end cross members 4*a*, 4*b* (FIG. 1); this stop projects downwardly below the cross member 4*a*, 4*b*, and thus beyond the support 1 (FIG. 5). If several supports 1 are placed one upon another, then the stops of the respective uppermost support engage in the region between two cross members 4 of the respective lower support. The facing inner sides 29, 30 of the end cross members 4*a*, 4*b* of the respective lower support then serve as counter-stops. The stops 27, 28 are provided eccentrically on the cross members 4*a*, 4*b*, in order that supports 1 disposed one on the other and turned through 180° with respect to each other, can be stacked in such a way that the stops bear against the associated counterstops 29, 30 of the respective lower support. By means of the stops 27, 28 and the counter-stops 29, 30, supports lying one on the other are prevented from moving in the longitudinal direction with respect to each other. In order that the supports are prevented from sliding in both longitudinal directions, the stops 27, 28 and the counter-stops 29, 30 are provided on the facing inner sides of the two end cross members 4*a*, 4*b*.

It is possible to prevent lateral displacement due to the fact that the lateral stops 12, 13 are not attached to the edges of the side plates 7, 8, but to their sides. Then, when the supports 1 are placed one on top of the other, the lateral stops 12, 13 bear against the outer sides of the side plates 7, 8 of the respective upper support. In this case, the lateral stops 12, 13 naturally do not extend over the entire height of the side plates 7, 8.

The stops 27, 28 are preferably pivotably mounted on the cross members 4*a*, 4*b*, so that they do not interfere when depositing the support on the ground. The stops are respectively seated on linch pins or pintles 31, 32, which pass through the end cross member 4*a*, 4*b* (FIG. 5). The stops 27, 28 are constructed in the form of plates. The swinging movement of the stops 27, 28 is limited in one direction by a lateral stop or an added transverse stop 33, 34, which is likewise attached to the inner sides 29, 30 of the end cross members 4*a*, 4*b*.

Provided respectively on the remote outer sides 35 and 36 of the end cross members 4*a*, 4*b* are holders 37, 38 for a cross beam 39, which will be described in detail subsequently with reference to FIGS. 12 and 13. The holders 37, 38 each comprise two spaced-apart plates 40 and 41 which are arranged one above the other (FIG. 5) in a congruent manner, and are attached to the outer sides 35 and 36 of the end cross member 4*a* and 4*b*. Half-way along their length, the plates 40, 41 are each provided with a through-bore 42, 43. The holders 37, 38 are located at the same height as the stops 27, 28 on the opposite sides of the respective cross members 4*a* and 4*b*. The pins 31, 32 project between the two plates 40, 41 of each holder (FIG. 5).

Figure 12:
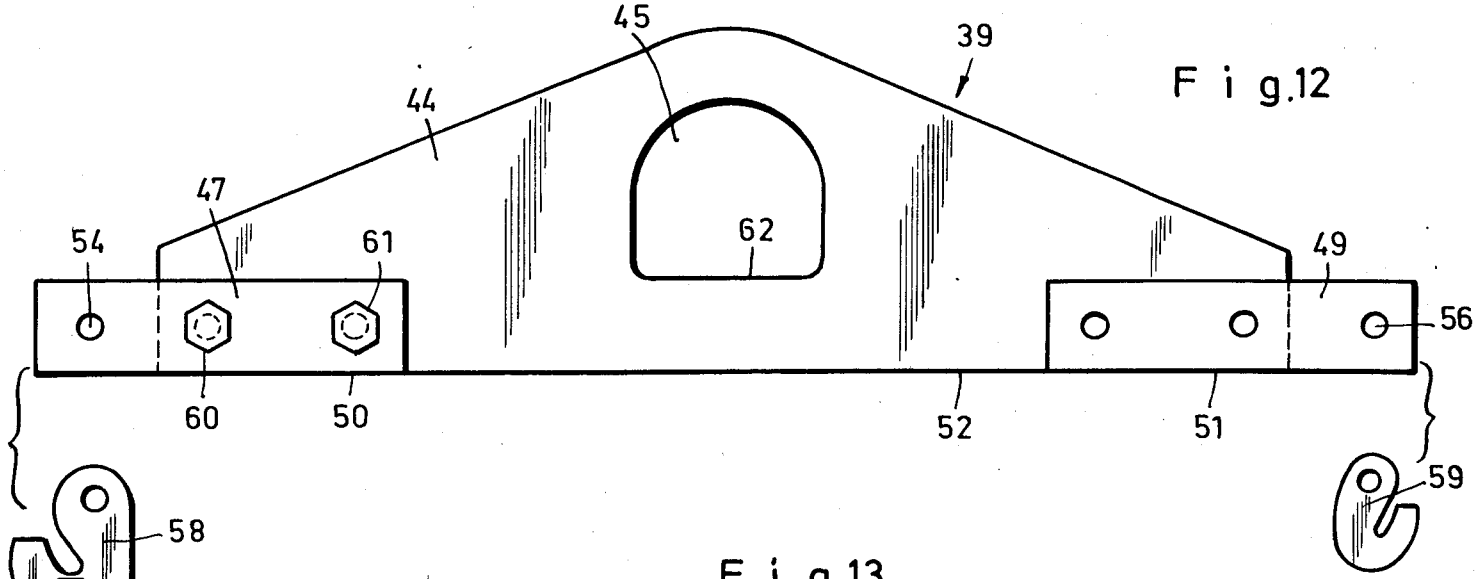
FIG. 12 is an elevational view that shows a first embodiment of a cross beam.
Figure 13:
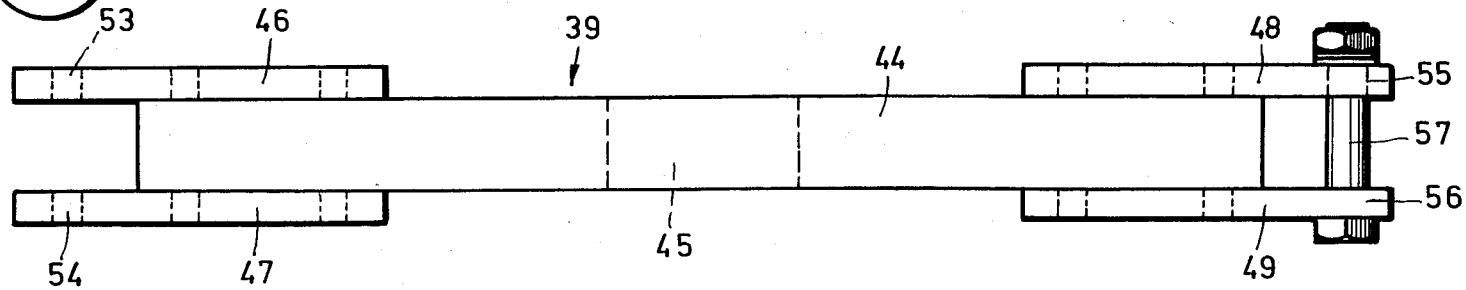
FIG. 13 is a plan view of the cross beam of FIG. 12.

The cross beam 39 according to FIGS. 12 and 13 serves for connecting the support 1 to the lifting gear (not shown). The cross beam 39 is essentially formed by a triangular plate 44, which in its center is provided with a suspension opening 45 for a suspension member of a lifting gear (not shown). The plate 44 is an obtuse-angled isosceles triangle, with those edges thereof which form the acute angles being bevelled. Screwed to these edges on both sides of the plate 44 are rectangular splice plates or brackets 46–49, which are of identical construction and project laterally beyond the plate 44. Their lower edges 50, 51 lie flush with the edge 52 of the plate 44. The projecting parts of the brackets 46–49 are provided with aligned insertion openings 53–56 for linch pins or pintles 57, by means of which hooks 58, 59 are attached between the splice plates. The brackets 46–49 are preferably detachably connected to the plate 44, in particular by threaded bolts 60, 61 which pass through the brackets and the plate.

To lift the support 1, one end of a strand of chain is suspended, for example, in the brackets 14–17, which chain is also suspended in the hooks 58, 59 of the cross beam 39. A hook of a lifting gear, such as a chain, is then hooked, for example, in the suspension opening 45 of the cross beam 39.

In order that the cross beams 39 are respectively near the associated support 1, the holders 37 and 38 are provided. The cross beams 39 are slid between the plates 40 and 41 of the holders 37, 38 in such a way that their edge 52 faces the associated end cross member **4*a*, 4*b*. A pin is then inserted through the bores 42 and 43 in the plates 40, 41, and through the suspension opening 45; as a result, the cross beam 39 is secured to the holder. The suspension opening 45 in the cross beam 39, and the bores 42, 43 in the holders 37, 38, are disposed in such a way that the pin bears against that edge 62 of the suspension opening 45 which is closest to the cross member 4*a*, 4*b* (FIG. 12), so that the cross beam cannot be moved at right angles to the cross members 4*a*, 4*b*. The length of the golders 37, 38 is preferably less than the distance between the brackets 46, 48 and 47, 49 of the cross beam 39, so that these brackets lie outside the holder in the storage position. Moreover, the thickness of the plate 44 of the cross beam 39 corresponds to the distance between the plates 40, 41 of the holders 37, 38, so that the cross beam is prevented from moving at right angles to the end cross members 4*a*, 4*b*. As shown in FIG. 1, the end cross members 4*a*, 4*b* are set back so far with respect to the ends of the longitudinal members 2, 3, that the holders 37, 38 and the cross beams 39 mounted thereon do not project in the longitudinal direction beyond the support 1**.

Whereas in the embodiment according to FIGS. 12 and 13, the cross beam 39 has an elongated construction, the cross beam **39*a* according to FIG. 14 is constructed in the approximate shape of an equilateral triangle having rounded corners. The cross beam 39*a* is formed by a plate 44*a*, which in the region of one rounded corner is provided with the suspension opening 45*a* for the engagement member of the lifting gear. Provided in each of the other two corner regions is a suspension opening 63 and 64 in which the chains, ropes and the like which are attached to the brackets 14–17 of the support 1 can be attached to suitable connecting members. The cross beam 39*a* can be attached in the same manner as the cross beam 39 of FIGS. 12 and 13 to the holders 37 and 38**, so that it cannot be lost and is available at all times.

Figure 8:
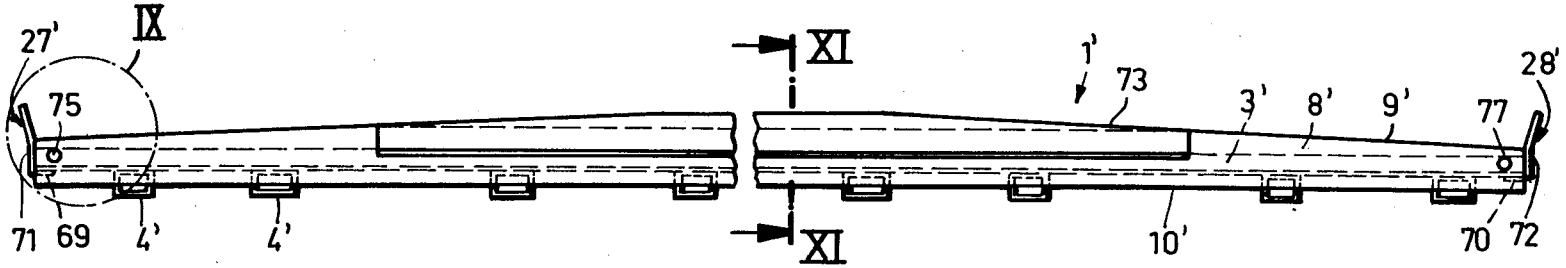
FIG. 8 is a side view that shows the support according to FIG. 7.
Figure 7:
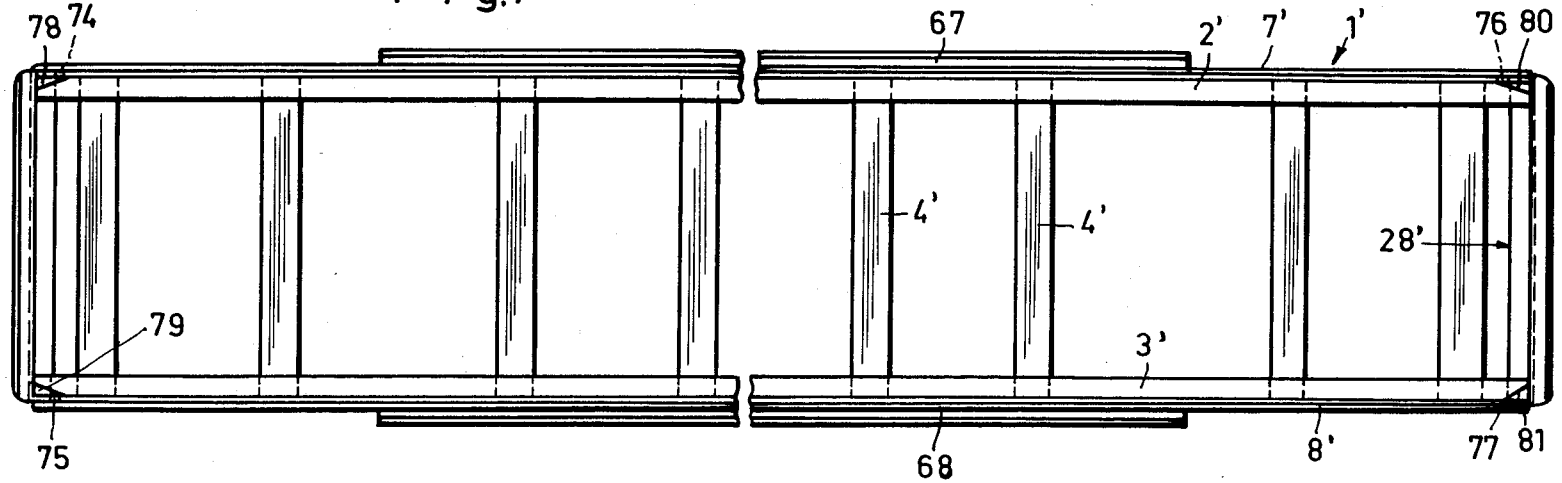
FIG. 7 is a plan view that shows a second embodiment of a support according to the invention.

The support 1' according to FIGS. 7 to 11 likewise has two longitudinal members 2' and 3' which are parallel to one another and are connected to each other by cross members 4' which are parallel to one another. The longitudinal members 2' and 3' are formed by L-shaped angle rails (FIG. 11), the longer arm 65 of which rests on the cross members 4', which are again constructed as hollow sectional members of rectangular cross-section. The longitudinal members 2', 3' project by the thickness of the shorter arm 66 beyond the cross members 4' (FIG. 11). Attached to each of the remote outer sides of the arms 66 of the longitudinal members 2' and 3' is a side plate 7' and 8', which extends over the entire length of the longitudinal members and projects beyond the arm 66 above and below (FIG. 11). Attached as lateral stops for supports 1' which are placed one above the other, on each of the remote outer sides of the side plates 7' and 8', are further side plates 67 and 68 which extend solely over part of the length of the longitudinal members 2' and 3' (FIG. 7). The lateral stops 67, 68 are preferably longer than half the length of the longitudinal members 2' and 3'. As shown in FIG. 8, from both ends of the lateral stops 67, 68, the upper edge 73 extends in an ascending manner and passes into a central section which extends parallel to the lower edge 10' of the side plates 67, 68. The upper half of each lateral stop 67, 68 is respectively bent outwardly, in which case the part which projects beyond the side plates 7', 8' serves as an actual lateral stop for the respective upper support 1'.

The ends of the longitudinal members 2' and 3' are connected to each other by means of stops 27', 28', which are formed by an angle rail of substantially L-shaped cross-section. Their short arm 69, 70 is attached to the underside of the arm 65 of the longitudinal member 2' and 3'. Their long arm 71, 72 is attached in the end region to the end faces of the side plates 7', 8'. The upper end of the stops 27', 28' is bent outwards at an obtuse angle (FIGS. 8 and 9). As a result of this bend, the supports 1' can be placed easily one on top of the other. Since the lateral stops 67, 68 are also bent outwardly at an obtuse angle in the upper region, the supports 1' can be placed neatly one on top of the other without danger of tilting or jamming.

Adjoining the lateral stops 67, 68, the upper edge 9' of the side plates 7' and 8' forms a continuation of the upper edge 73 of these lateral stops, as seen in the side view according to FIG. 8. In the region of the lateral stops 67, 68, the upper edge 9' of the side plates 7', 8' extends parallel to their lower edge 10' and forms a stacking surface on which the respective upper support 1', in the stacked position, rests via the lower edge 10'.

So that the support 1' can be raised by means of chains, ropes, and the like, suspension openings 74–77 are provided in the end regions of the longitudinal members 2' and 3'. In the region of these suspension openings, the longer arm 65 of the longitudinal members 2' and 3' is provided with a recess 78–81, which in this embodiment is triangular, so that the parts which are to be suspended in the openings 74–77 will have sufficient space.

In the aforedescribed embodiments of supports 1 and 1', the cross members 4, 4' project downwardly beyond the longitudinal members 2, 2' and 3, 3'. Since the cross members are constructed as hollow sectional members, support rods and the like can be inserted therethrough, which can project laterally beyond the support 1 and 1' and to which connecting parts for sling chains can be attached. Thus, support rods of this type can be located in some or in all cross members 4, 4', so that even relatively long supports 1, 1' can be raised and transported without danger of bowing.

The present invention is, of course, in no way restricted to the specific disclosure of the specification and drawings, but also encompasses any modifications within the scope of the appended claims.

What we claim is:

1. An apparatus for lashing goods that are transported, whereby a lashing means is wound at least partly around the goods and can subsequently be held taut in the lashed position; said apparatus comprising:

at least one portable support for said goods, said portable support being provided with opposite end regions and at least one stacking surface and edges as well as mountings with insertion openings therewith;

at least one stop in vicinity of at least one of said end regions and provided on said portable support; and at least one counter-stop disposed on said portable support in vicinity of at least one of said end regions and at right angles to the longitudinal direction of said portable support.

2. An apparatus according to claim 1, in which said support has two opposite end regions, and said stop being in the vicinity of at least one of said end regions.

3. An apparatus according to claim 2, in which said support includes two longitudinal members, each having two ends, one in each of said end regions of said support; said stop being a cross bar which connects the two ends of said longitudinal members in a given one of said end regions.

4. An apparatus according to claim 2, in which said support includes at least one longitudinal member, and cross members connected to and extending at right angles to said longitudinal members; said stop being provided on said cross members.

5. An apparatus according to claim 4, which includes an end cross member in each of said two end regions of said support, with at least one of said end cross members being provided with one stop.

6. An apparatus according to claim 5, in which said end cross members have inner sides which are directed toward one another, said stop being provided on said inner sides of said end cross members.

7. An apparatus for lashing goods, whereby a lashing means is wound at least partly around the goods and can subsequently be held taut in the lashed position; said apparatus comprising:

at least one portable support for said goods, said portable support being provided with at least one stacking surface;

at least one stop provided on said portable support;

at least one counter-stop disposed on said portable support and at right angles to the longitudinal direction thereof; said portable support having two opposite end regions, said stop being in the vicinity of at least one of said end regions; at least one longitudinal member included with said portable support, and cross members connected to and extending at right angles to said longitudinal member in intermediate locations along longitudinal direction thereof; said stop being provided on said cross members; and end cross members included in each of said two end regions of said portable support respectively, with at least one of said end cross members being provided with one stop; said end cross members having inner sides which are directed toward one another, said stop being provided on said inner sides of said end cross members; said stop being movable from an arresting position into a releasing position, and back again.

8. An apparatus according to claim 7, in which each support includes a transverse stop for limiting movement of said stop.

9. An apparatus according to claim 8, in which said transverse stop is disposed on said inner sides of said end cross members.

10. An apparatus according to claim 6, in which each of said end cross members is provided with a holder for a cross beam.

11. An apparatus according to claim 10, in which each of said holders is disposed on that side of its associated end cross member opposite said inner side on which said stop is disposed.

12. An apparatus according to claim 11, in which each of said holders is formed by two plates which are disposed one above the other and at a distance from one another, and project from said end cross members; at least one of said plates is provided with an insertion opening for a retaining member.

13. An apparatus according to claim 12, in which each of said cross beams is formed by a plate having connecting means for connecting members.

14. An apparatus according to claim 13, in which said connecting means are formed by brackets which are disposed on opposite sides of said plate and project beyond the latter.

15. An apparatus according to claim 14, which includes transverse bolts for interconnecting said brackets and serving as suspension members for said connecting members.

16. An apparatus according to claim 13, in which said connecting means are through-bores in said plate of said cross beam.

17. An apparatus according to claim 2, in which said support includes two longitudinal members, and in which said support is provided with side parts on which are formed lateral stops.

18. An apparatus according to claim 17, in which said side parts are attached to said longitudinal members.

19. An apparatus according to claim 18, in which said side parts are provided with mountings in the form of connection fittings for receiving stacking aids.

20. An apparatus for lashing goods that are transported with at least one support for the goods, said support having a length and being bounded by side walls which project beyond said support and which are formed by side plates extending over the length of said support; and lateral stops having a stop function as well as a stiffening function as formed by said side plates which extend over a portion including approximately half of length of said side plates as well as upwardly extending parts thereof projecting over said side plates and inclined outwardly thereof for receiving and taking up high resistance moments therewith.

* * * * *